United States Patent [19]

Gerakiteys

[11] Patent Number: 4,527,351

[45] Date of Patent: Jul. 9, 1985

[54] LEVITATED BALL TOY

[76] Inventor: Peter K. Gerakiteys, P.O. Box 463, Newcastle, N.S.W. 2300, Australia

[21] Appl. No.: 328,586

[22] PCT Filed: Mar. 25, 1981

[86] PCT No.: PCT/AU81/00034

§ 371 Date: Nov. 25, 1981

§ 102(e) Date: Nov. 25, 1981

[87] PCT Pub. No.: WO81/02680

PCT Pub. Date: Oct. 1, 1981

[51] Int. Cl.[3] ..... A63H 29/16

[52] U.S. Cl. ..... 446/202; 272/8 R

[58] Field of Search ..... 46/44, 56, 53, 41, 1 R; 272/8 R, 8 N, 27 B, 27 W; 434/300, 302

[56] References Cited

U.S. PATENT DOCUMENTS

| | | | |
|---|---|---|---|
| 2,118,609 | 5/1938 | Klug | 46/44 |
| 2,198,509 | 4/1940 | Burke | 46/44 X |
| 3,087,278 | 4/1963 | Waggle, Jr. | 46/44 |

OTHER PUBLICATIONS

"Things to Make", Williams, A. ©1913, p. 319.

*Primary Examiner*—Mickey Yu

*Attorney, Agent, or Firm*—Henry M. Bissell

[57] ABSTRACT

A child's toy having two parts, a tube part for directing a stream of air and a light ball which can be supported by the stream of air. The tube has a mouthpiece at one end with a cup at the other end. The cup has a slightly more concave curvature than the convex curvature of the ball creating an air space between the cup and the ball. A port in the cup connects the tube to the air space and biases the flow of air in one direction causing the ball to spin when the ball is offered to the cup and a stream of air is blown down the tube.

6 Claims, 2 Drawing Figures

LEVITATED BALL TOY

This invention concerns children's toys.

This invention provides a toy comprising a very light ball and a tube, one end of said tube being intended for apposition to the lips for directing a stream of air through the tube toward a cup fixed to the opposite end of the tube, said cup having a concave surface which approximately mates with the surface of the ball and which extends over less than half of the surface of the ball such that when the ball is placed beneath the cup, held in contact with the cup and a steady stream of air is expressed from the cup the ball is trapped by the airstream and remains in close proximity to the cup.

The cup need only be shallow, covering a relatively small area of the accompanying ball. The air supplied from the tube is preferably admitted to the cup by a central port but I have found that if the ball is to be supported by the airstream certain design criteria are advisable. Firstly, the toy works best if the cup has a curvature which causing the cup to contact the ball more closely at the cup lip than in the vicinity of the port. Secondly, the port if circular, should be relieved or chamfered in one sector which biasses the escaping air in one direction. If this modification is absent the ball will be supported but will not spin. Thirdly, the cup should be asymmetrical such that the cup is canted in the direction of the relief or chamfer so that the escaping air follows a slightly longer path before it escapes from the lip in said direction than in the opposite direction.

Figure 1:
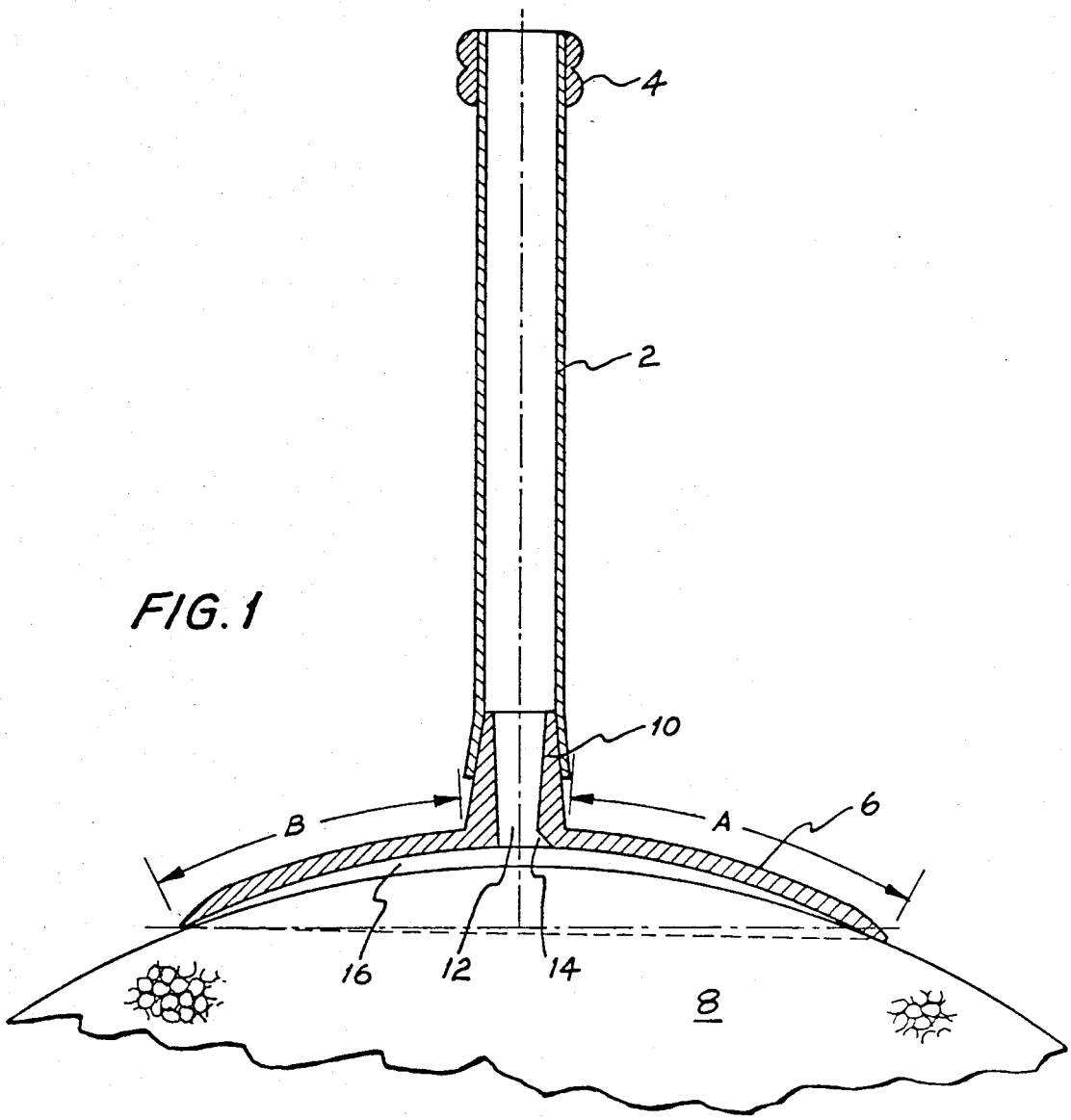

One example of the invention is now described with reference to the accompanying drawings in which FIG. 1 is a sectional view of the tube and part of the ball.

Figure 2:
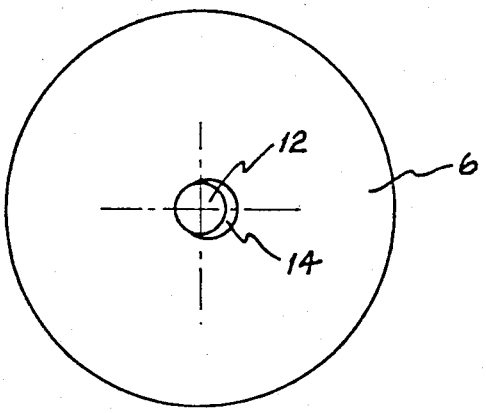

FIG. 2 is an underneath plan of the cup on a reduced scale showing the port and chamfer.

Referring now to the drawings a thin walled tube 2 about the size of a drinking straw has a moulded mouthpiece 4 at one end and a moulded cup 6 (38 mm diameter) at the opposite end. A ball 8 (75 mm diameter) made of expanded polystyrene beads such as are commonly sold for darning purposes is shown occupying the spinning position. The cup 6 has a spigot 10 over which the tube is a push fit. The tapered bore of the spigot terminates in port 12 which opens into the bowl of the cup. The lip of the cup almost touches the ball surface but the port 12 is separated from the ball surface by an air space 16. The port 12 is circular being of 3 mm diameter and has a crescent-shaped chamfer 14 created by a cup of 5 mm diameter inset in the bowl around the port 12. The lip of the cup is canted so that the distance marked A is slightly greater (1 mm) than the distance marked B.

One blows steadily down the tube and holds the ball in the cup until such time as the airstream hugs the ball and rotates the latter rapidly.

As a variation the tube may be used to direct a stream of air obliquely upwards whereupon the ball floats above the cup.

I claim:

1. A toy comprising a very light ball and a tube, one end of said tube being intended for apposition to the lips for directing a stream of air through the tube toward a cup fixed to the opposite end of the tube, said cup having a concave surface which approximately mates with the surface of the ball and which extends over less than half of the surface of the ball such that when the ball is placed beneath the cup, then offered up to the cup and the ball contacts the lip of the cup, there is a clearance between the ball and the curved surface of the cup, which clearance is greater at the center of the cup, and then a steady stream of air is expressed from the cup, the ball is trapped by the airstream and remains in close proximity to the cup, wherein the tube is connected to the cup at the center of the cup and air is admitted from the tube to the cup by a central port which is relieved or chamfered in one sector in order to bias the escaping air in one direction which causes the supported ball to spin.

2. A toy as claimed in claim 1 wherein the cup is asymmetrically located about the port such that the cup is canted in the direction of the relief or chamfer so that the path of the escaping air follows a slightly longer path before it escapes from the lip in said one direction then in the opposite direction.

3. A toy as claimed in claim 1 or claim 2 wherein the cup has an integral spigot, one end of which is engaged by the tube, the opposite end of which terminates in said port, the intervening region of the spigot being internally profiled to define a venturi.

4. A toy comprising a tube for use in association with a very light, generally spherical ball, one end of said tube being intended for apposition to the lips for directing a stream of air through the tube toward a cup fixed to the opposite end of the tube, said cup having a concave surface which approximately mates with the surface of the ball and which extends over less than half of the surface of the ball such that when the ball is placed beneath the cup, then offered up to the cup and the ball contacts the lip of the cup, there is a clearance between the ball and the curved surface of the cup, which clearance is greater at the center of the cup than about the periphery, and then a steady stream of air is expressed from the cup, the ball is trapped by the airstream and remains in close proximity to the cup, wherein the tube is connected to the cup at the center of the cup and air is admitted from the tube to the cup by a central port which is relieved or chamfered in one sector in order to bias the escaping air in one direction which causes the supported ball to spin.

5. A toy as claimed in claim 4 wherein the cup is asymmetrically located about the port such that the cup is canted in the direction of the relief or chamfer so that the path of the escaping air follows a slightly longer path before it escapes from the lip in said one direction than in the opposite direction.

6. A toy as claimed in claim 4 or claim 5 wherein the cup has an integral spigot, one end of which is engaged by the tube, the opposite end of which terminates in said port, the intervening region of the spigot being internally profiled to define a venturi.

* * * * *